US008753005B2

(12) United States Patent
Singh et al.

(10) Patent No.: US 8,753,005 B2
(45) Date of Patent: Jun. 17, 2014

(54) APPARATUS FOR MIXING THE CONTENTS OF A CONTAINER

(75) Inventors: Vijay Singh, Bernardsville, NJ (US); Willy Papke, Bridgewater, NJ (US)

(73) Assignee: GE Healthcare Bio-Sciences Corp., Piscataway, NJ (US)

( * ) Notice: Subject to any disclaimer, the term of this patent is extended or adjusted under 35 U.S.C. 154(b) by 0 days.

(21) Appl. No.: 13/550,956

(22) Filed: Jul. 17, 2012

(65) Prior Publication Data

US 2012/0281495 A1 Nov. 8, 2012

Related U.S. Application Data

(63) Continuation of application No. 12/600,532, filed as application No. PCT/US2008/065479 on Jun. 2, 2008.

(60) Provisional application No. 60/941,766, filed on Jun. 4, 2007.

(51) Int. Cl.
*B01F 7/04* (2006.01)

(52) U.S. Cl.
USPC ..... 366/205; 366/279; 366/314; 366/331; 366/343

(58) Field of Classification Search
USPC ..... 366/197, 199, 206, 129, 130, 244, 245, 366/246, 267, 279, 343, 205, 314, 331, 200, 366/201, 276, 277, 278, 325.4, 325.5, 366/325.92, 325.93, 327.1, 328.2, 328.3, 366/328.4, 202; 68/133, 134
See application file for complete search history.

(56) References Cited

U.S. PATENT DOCUMENTS

| | | | | | |
|---|---|---|---|---|---|
| 114,873 | A | * | 5/1871 | Steele | 366/276 |
| 649,683 | A | * | 5/1900 | Spanier | 416/69 |
| 716,840 | A | * | 12/1902 | Hooper | 366/343 |
| 1,678,468 | A | * | 7/1928 | Herron | 416/75 |
| 1,712,156 | A | * | 5/1929 | Morgan | 416/77 |
| 1,837,636 | A | * | 12/1931 | Voss | 366/325.4 |
| 1,844,347 | A | * | 2/1932 | Chapman | 99/348 |
| 2,007,249 | A | * | 7/1935 | Kelley | 416/69 |
| 2,073,540 | A | * | 3/1937 | Tittle | 68/134 |
| 2,149,987 | A | * | 3/1939 | Altorfer | 68/54 |
| 2,169,607 | A | * | 8/1939 | Kelley | 366/343 |
| 2,228,057 | A | * | 1/1941 | Kirby | 68/54 |
| 2,718,775 | A | * | 9/1955 | Stephens | 68/134 |
| 2,821,848 | A | * | 2/1958 | Becker | 68/17 A |
| 3,035,451 | A | * | 5/1962 | O'Connell et al. | 74/133 |
| 3,045,988 | A | * | 7/1962 | Briscoe | 366/285 |
| 3,353,377 | A | * | 11/1967 | Worst | 68/23.7 |
| 3,987,651 | A | * | 10/1976 | Platt | 68/133 |
| 3,987,652 | A | * | 10/1976 | Ruble | 68/134 |
| 4,010,934 | A | * | 3/1977 | McCord et al. | 366/142 |
| 4,048,820 | A | * | 9/1977 | Pielemeier | 68/133 |

(Continued)

FOREIGN PATENT DOCUMENTS

JP 2003-200030 7/2003

*Primary Examiner* — Tony G Soohoo

(57) ABSTRACT

An apparatus for mixing materials is disclosed. The apparatus includes a support. A mixing container is disposed in the support, where the mixing container is configured to retain materials. A driver assembly is configured to protrude through the support and into the mixing container. The mixing container includes a paddle, the driver assembly is configured to be attached to the paddle, where the driver assembly is configured to oscillate the paddle in a back and forth direction at a set angle in order to mix the materials in the mixing container.

17 Claims, 15 Drawing Sheets

(56) References Cited

U.S. PATENT DOCUMENTS

| | | | | | |
|---|---|---|---|---|---|
| 4,068,503 | A * | 1/1978 | Platt | 68/133 |
| 4,112,518 | A * | 9/1978 | Garlinghouse | 366/219 |
| 4,127,015 | A * | 11/1978 | Platt et al. | 68/133 |
| 4,155,228 | A * | 5/1979 | Burgener et al. | 68/133 |
| 4,164,130 | A * | 8/1979 | Hammer | 68/133 |
| 4,199,112 | A * | 4/1980 | McLean | 241/92 |
| 4,355,906 | A * | 10/1982 | Ono | 366/308 |
| 4,631,771 | A * | 12/1986 | Anderson et al. | 68/23.7 |
| 4,676,658 | A * | 6/1987 | Herfeld | 366/197 |
| 4,719,769 | A * | 1/1988 | Pielemeier et al. | 68/133 |
| 4,944,600 | A * | 7/1990 | McKelvey | 366/276 |
| 5,183,336 | A * | 2/1993 | Poltorak et al. | 366/308 |
| 5,193,977 | A * | 3/1993 | Dame | 415/206 |
| 5,261,746 | A * | 11/1993 | Boasso | 366/276 |
| 5,289,731 | A * | 3/1994 | Womack | 74/133 |
| 5,479,793 | A * | 1/1996 | Savkar et al. | 68/133 |
| 5,533,804 | A * | 7/1996 | Larsson et al. | 366/274 |
| 5,577,407 | A * | 11/1996 | Savkar et al. | 68/133 |
| 5,578,012 | A * | 11/1996 | Kamen et al. | 604/151 |
| 5,590,550 | A * | 1/1997 | Savkar et al. | 68/133 |
| 5,611,221 | A * | 3/1997 | Tremel | 68/133 |
| 5,638,704 | A * | 6/1997 | Kim et al. | 68/3 SS |
| 5,676,463 | A * | 10/1997 | Larsen | 366/251 |
| 5,934,800 | A * | 8/1999 | Bonacci | 366/228 |
| 6,007,237 | A * | 12/1999 | Latto | 366/315 |
| 6,416,212 | B1 * | 7/2002 | Rogers et al. | 366/117 |
| 6,494,613 | B2 * | 12/2002 | Terentiev | 366/279 |
| 6,523,994 | B2 * | 2/2003 | Lawson | 366/199 |
| 6,616,322 | B1 * | 9/2003 | Ashcroft et al. | 366/167.2 |
| 6,837,610 | B2 * | 1/2005 | Cadogan et al. | 366/275 |
| 6,883,958 | B2 * | 4/2005 | Mayer | 366/197 |
| 6,883,960 | B2 * | 4/2005 | Reeder et al. | 366/276 |
| 6,908,223 | B2 * | 6/2005 | Bibbo et al. | 366/333 |
| 7,033,499 | B2 * | 4/2006 | Cohee et al. | 210/321.75 |
| 7,077,559 | B2 * | 7/2006 | Hlavinka et al. | 366/197 |
| 7,086,778 | B2 | 8/2006 | Terentiev | |
| 7,249,880 | B2 * | 7/2007 | Zambaux | 366/277 |
| 7,318,375 | B2 * | 1/2008 | Huang | 99/348 |
| 7,431,494 | B2 * | 10/2008 | Zambaux | 366/144 |
| 2002/0145938 | A1 * | 10/2002 | Sasaki | 366/220 |
| 2002/0172092 | A1 * | 11/2002 | Reeder et al. | 366/270 |
| 2003/0231546 | A1 * | 12/2003 | Bibbo et al. | 366/276 |
| 2005/0239199 | A1 * | 10/2005 | Kunas et al. | 435/297.1 |
| 2005/0249033 | A1 * | 11/2005 | Krause | 366/332 |
| 2006/0146645 | A1 * | 7/2006 | Rosener | 366/274 |
| 2006/0207944 | A1 * | 9/2006 | Siddiqi | 366/273 |
| 2010/0149908 | A1 * | 6/2010 | Singh et al. | 366/276 |
| 2012/0281495 | A1 * | 11/2012 | Singh et al. | 366/276 |

* cited by examiner

APPARATUS FOR MIXING THE CONTENTS OF A CONTAINER

CROSS-REFERENCE TO RELATED APPLICATIONS

This application is a continuation of U.S. patent application Ser. No. 12/600,532 filed Nov. 17, 2009, which is a filing under 35 U.S.C. §371 and claims priority to international patent application number PCT/US2008/065479 filed Jun. 2, 2008, published on Dec. 11, 2008, as WO 2008/151105, which claims priority to U.S. provisional patent application No. 60/941,766 filed Jun. 4, 2007; the entire disclosure of which is incorporated herein by reference in its entirety.

FIELD OF THE INVENTION

The present invention relates to an apparatus for mixing the contents of a container.

BACKGROUND OF THE INVENTION

Generally, when bioprocess or pharmaceutical companies want to blend materials to produce a specific material they utilize a mixing container, such as a steel tank mixer or a disposable mixing system. These disposable systems, or single use devices are preferred over stainless steel tanks with their inherent high labor and materials cost for cleaning, because considerable savings in operating and capital cost. The use of single-use devices also minimizes the risk of product carryover and cross-contamination.

However, there are several problems associated with current disposable mixing systems. First, a major problem with developing a disposable mixing system is the manufacturing of a reliable aseptic seal that is inexpensive enough to be discarded after just one use, such as a mixing device that utilizes a low cost plastic bushing seals with a rotating propeller shaft. These seals cannot be relied upon to provide aseptic operation essential for pharmaceutical operations. The cost of such bags with their complex internals is too high for mixer applications, and most of their utility is in high performance applications such as fermentation and cell culture where their high cost can be justified.

Next, magnetically coupled seals offer an alternative to the bushing seals, such as a mixing device with a stir bar placed in a plastic bag that is driven by an external magnetic drive. The advantage of this method is that the fluid inside the mixing bag is completely isolated from the drive. The disadvantage is that, due to economic concerns, the stir bar is very small compared to the container diameter, and consequently performs poorly as a mixer. Since the stirrer is situated at the bottom of the bag, most of the fluid circulation induced by the stir bar fails to get to the upper regions of the mixing bag. The amount of power that can be transmitted through the magnetic coupling is limited. Some efforts have been made to use superconducting magnets to improve the power transmission efficiency, but these are costly to operate, and require liquid nitrogen to maintain the superconducting operation. Scaling up disposable magnetically coupled mixers is quite difficult and the utilization of commercial systems over 100 liters is unlikely. In addition, the stir bar is typically discarded after a single use that leads to a high cost of disposables and a problem with environmental disposal of the rare-earth magnets used in such applications.

A number of attempts have been made to develop a sealless disposable mixer, such as a mixing bag with an oscillating disk mounted at the bottom. The disk is forced to oscillate in the vertical dimension and its movement induces a circulation flow. This device has failed to find any significant commercial application because the fluid motion rapidly diminishes towards the upper regions of the container. The mixing performance is even poorer if the liquid phase has a high viscosity. The problem is that the mechanism constrains the vertical motion of the disk. Thus despite the relatively large diameter of the disk, the amount of fluid moved every oscillation is too small for it to function as an effective mixer.

Next, there is a mixer with multiple mixing platforms in a bag with a vertical shaft with horizontal mixer platforms. The shaft is moved up and down to mix the contents of the bag. The shaft is fixed to the upper surface of the bag that eliminates the need for a rotary seal, but the maximum possible stroke length is small due to the maximum allowable deflection of the top surface. This leads to poor mixing performance. In addition, bulk of the liquid flow bypasses the mixer platforms along the side walls, also reducing mixer efficiency.

Therefore, there is a need for an apparatus that provides the user with a mixing system that has a good mixing performance and is efficient. Also, there is a need for a mixing system that preserves its hermetic integrity and does not require any type of seal.

SUMMARY OF THE INVENTION

The present invention has been accomplished in view of the above-mentioned technical background, and it is an object of the present invention to provide an apparatus that has good mixing performance and can be manufactured at a low cost.

In a preferred embodiment of the invention, an apparatus for mixing materials is disclosed. The apparatus includes a support. A mixing container is disposed in the support, where the mixing container is configured to retain materials. A driver assembly is configured to protrude through the support and into the mixing container. The mixing container includes a paddle, the driver assembly is configured to be attached to the paddle, wherein the driver assembly is configured to oscillate the paddle in a back and forth direction at a set angle in order to mix the materials in the mixing container.

In another preferred embodiment of the invention, a mixing device is disclosed, which includes a support. A mixing container is disposed in the support, where the mixing container is configured to retain materials. The mixing container includes a mixing bag and a sleeve, where the sleeve is disposed inside the mixing bag. A driver assembly is configured to protrude through the support into the sleeve. A paddle is inside the sleeve, where the sleeve is configured to isolate the paddle from an environment outside of the mixing bag. The paddle may extend vertically 5% to 95% of a vertical height of the mixing container. The driver assembly is configured to oscillate the paddle in a back and forth direction at a set angle in order to mix the materials in the mixing container.

BRIEF DESCRIPTION OF THE DRAWINGS

These and other advantages of the present invention will become more apparent as the following description is read in conjunction with the accompanying drawings, wherein.

DETAILED DESCRIPTION OF THE PREFERRED EMBODIMENTS

The presently preferred embodiments of the invention are described with reference to the drawings, where like components are identified with the same numerals. The descriptions of the preferred embodiments are exemplary and are not intended to limit the scope of the invention.

The present mixing assembly relates to mixing the contents of materials in containers that enable the user to mix components, mix and suspended solids in a single-use disposable format that eliminates cleaning, and reduces contamination. The mixing apparatus overcomes all the prior art limitations by 1) not having any contamination-prone rotating seals; 2) providing a very low cost container without any expensive magnetic stir bars or impellers; 3) providing a container that can be cheaply constructed from a variety of available materials; 4) is scalable in general to large volumes (up to at least 10,000 liters); and 5) requires only a low cost mixing support and a simple rotary mechanical drive assembly. The present apparatus utilizes a novel container with an internal mixing paddle that is oscillated, resulting in a low cost, yet very efficient mixing device.

The present apparatus encompasses a method for mixing ingredients inside a sealed plastic bag, which is a very important application in the bioprocess and pharmaceutical industry. The apparatus is suitable for applications requiring clean operation and the single-use design prevents cross-contamination and product carryover often encountered with poorly cleaned mixing tanks. The apparatus may be operated in an open top configuration for ease of component addition. It can also be manufactured in a completely closed configuration with all additions being made through ports in applications requiring such safeguards. The apparatus can be provided pre-sterilized by gamma radiation for applications requiring a sterile mixing vessel. The present apparatus eliminates the need for a rotary seal.

Figure 1:
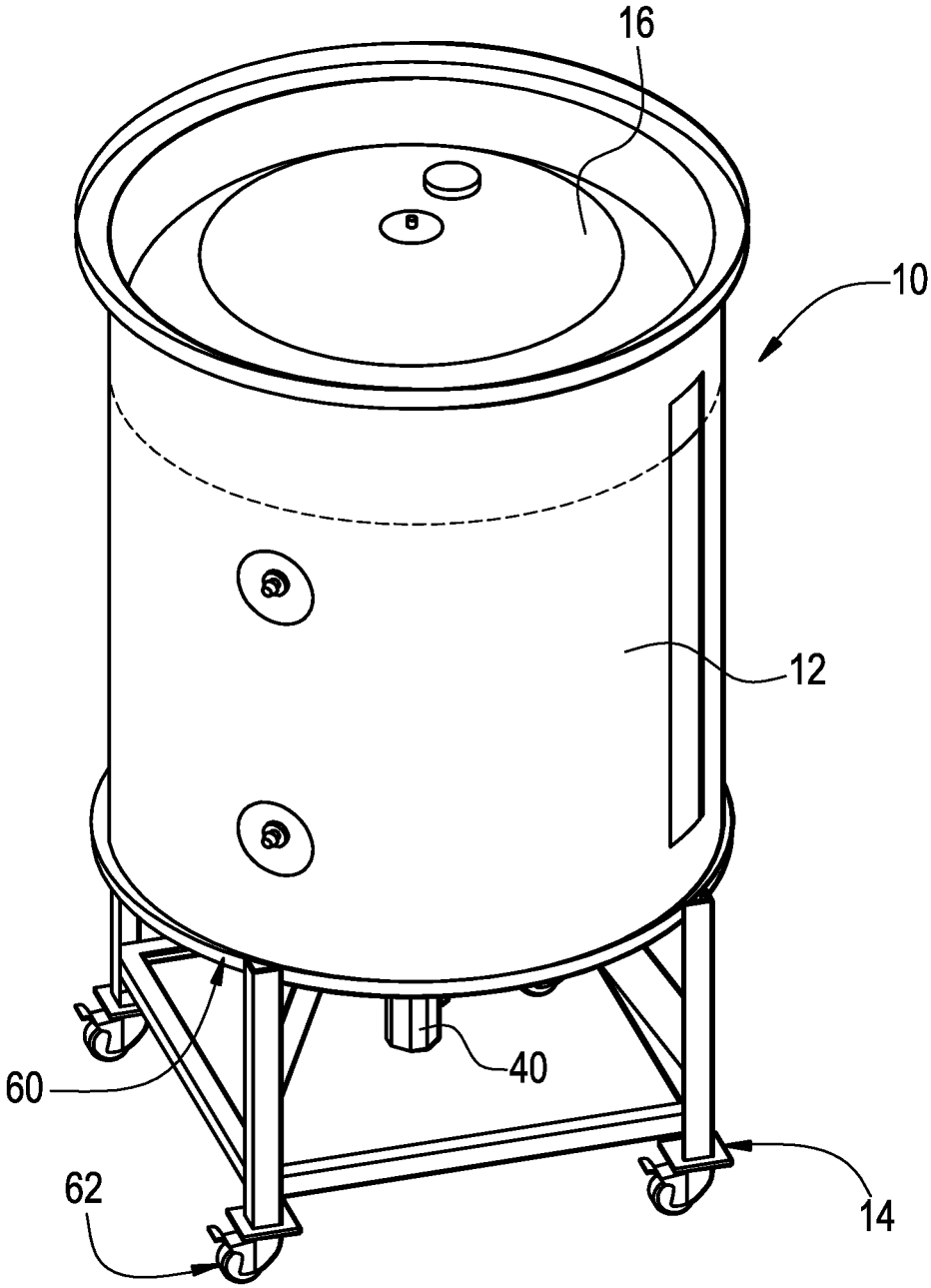
FIG. 1 is a perspective view of the mixing apparatus in accordance with an embodiment of the invention.

FIG. 1 illustrates a mixing device. A mixing device 10 is depicted in FIG. 1. The mixing device 10 includes a substantially rigid support 12 placed on a typical dolly 14. The dolly 14 includes a frame 60 and wheels 62. Disposed within frame 60 is a mechanical mixer driver 40 or typical driver assembly 40, which is disposed within support 12, is a mixing container 16. As will be discuss as follows in greater detail, the mechanical mixer driver 40 is used to mix materials, such as a fluid disposed within mixing container 16.

The support 12 may be a tank or barrel molded from polymeric materials. In alternative embodiments, support 12 can be comprised of metal, fiberglass, composites, plastics or any other desired material. While the support 12 is shown as a substantially cylindrical configuration, in alternate embodiments, support 12 may have a polygonal, elliptical, irregular or any other desired shape.

Figure 2:
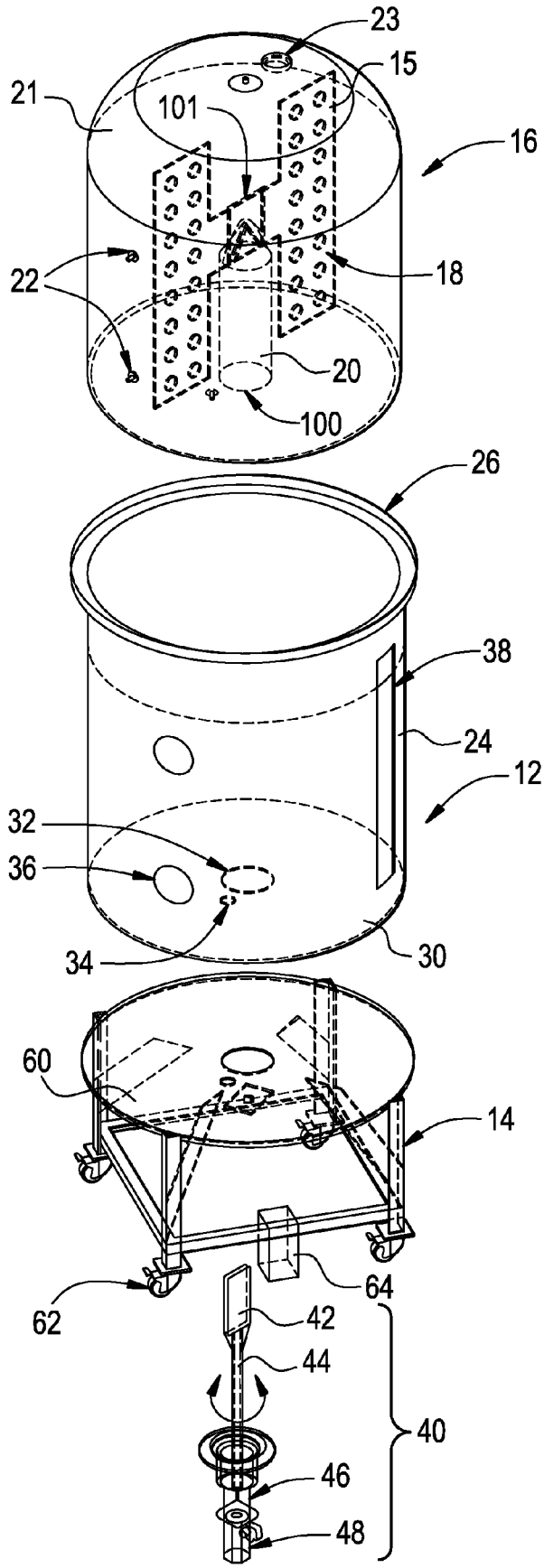
FIG. 2 is a partially exploded view of the mixing apparatus shown in FIG. 1 in accordance with the invention.

FIG. 2 illustrates a support, mixing container and a dolly. The support 12 includes a substantially cylindrical side wall 24 that extends from the top edge 26 to a floor or bottom wall 30 connected to side wall 24. A central hole 32 is provided in floor 30 such that when support 12 is placed onto frame 60, a drive shaft 44 and a clamp 42 or a coupler 42 of drive assembly 40 is able to protrude into support 12. Although, the driver assembly 40 is shown mounted to the frame 60, it can be mounted to the support 12. The support 12 may also be a split design that may be split vertically, horizontally or into segments to ease in the installation of the mixing container 16 into support 12. Driver assembly 40 may also be referred to as an oscillating driver assembly In an embodiment of the invention, driver assembly 40 also includes a typical electric servo motor 48 coupled mechanically to a typical gearbox 46, which in turn is coupled mechanically to a first end of the drive shaft 44. Driver assembly 40 acts as a typical servo motor amplifier that is controlled by a computer, which is able to control the motion of the shaft 44 to start and stop, such as utilizing the electric servo motor 48 and the typical gearbox 46 to instruct the shaft 44 to move 4000-8000 steps per second. In other embodiment of the invention, the electric servo motor 48 and/or gearbox 46 may be replaced with various mechanisms such as gears, cams, pneumatic pistons, hydraulic pistons or other devices that would generate the required oscillating motion. Clamp 42 is attached to a second end of the drive shaft 44. The driver assembly 40 is attached to frame 60 such that only shaft 44 and clamp 42 can rotate a paddle 18 about the vertical axis or the longitudinal axis of the mixing container 16. The driver assembly 40 rotates, drives or oscillates the paddle 18 in one direction through a preset angle and then reverses direction to rotate back to the starting position, and then continue through a set angle that has a range of 1 to 360 degrees in either direction. Once actuated, this cycling or oscillation motion repeats automatically. Various mechanisms such as gears, cams, pneumatic pistons and other devices in place of drive electric servo motor 48 and/or gearbox 46 can be used to generate the required oscillating motion. Also, the drive assembly 40 may be independent of the frame 60. The driver assembly 40 is located under the mixing device 10, which leaves the entire top free for ports 25 (FIG. 4) and 23 and easy user access. Alternatively, the driver assembly 40 could be mounted on the top with the sleeve 20 and paddle 18 hanging downwards.

Referring to FIGS. 2 through 6, mixing container 16 includes a container or mixing bag 21 with a sleeve 20 extending at a first end 100 from an opening in a wall of the mixing bag 21 into the interior of the mixing container 16 to a second closed end 101,103.

A driver assembly 40 is utilized to move the paddle 18 inside the mixing container 16 and is mounted to the closed end 101,103 of the sleeve 20. The driver assembly 40 moves the paddle 18 in an oscillating motion to mix materials in the mixing container 16. Ports 22, 25 and 23 can be provided on the mixing bag 21. The mixing container 16 is placed inside support 12 such that the sleeve 20 slides over clamp 42 and drive shaft 44. Paddle 18 disposed within mixing container 16 fits into clamp 42 such that the sleeve 20 and the paddle 18 follow the rotation of drive shaft 44.

Unlike conventional mixers that rotate continuously in one direction, the present mixing device 10 has a paddle 18 that oscillates about the longitudinal axis of the mixing container 16. The paddle 18 is isolated from the outside environment of the mixing bag 21 by the flexible sleeve 20, where the sleeve 20 is inside the mixing container 16. The sleeve 20 may be made of a multi-layer material that has anywhere from 1-10 layers. Preferably, the sleeve 20 is made of 1-3 ply material. The material utilized to make the sleeve 20 may be made of a coated nylon, a siliconized coated material, polyethylene, silicone, molded structure, a splyrene structure or spiral structure. The paddle 18 is driven by the drive shaft 44 (FIG. 6B) that fits inside the flexible sleeve 20. In this manner, the drive shaft 44 is not in contact with the contents of the mixing container 16. The drive shaft 44 rotates back and forth through a set angle. This set angle may be anywhere between 1 to 360 degrees in either direction depending on the application of the drive shaft 44.

Referring to FIG. 2, the flexible sleeve 20 twists back and forth during the mixing process but since it never undergoes a continuous rotation in any one direction, any twist in one direction (one stroke) is rapidly unwound when the device twists in the opposite direction (return stroke). The two strokes make up one cycle. The paddle 18 with the flexible sleeve 20 is able to twist in one direction approximately 10-60 cycles per minute. Preferably, the paddle 18 with the flexible sleeve 20 is able to twist 30 cycles per minute. The design and materials of the sleeve 20 are chosen such that the sleeve 20 can operate for millions of cycles. The back and forth action of the shaft 44 and stirrer 15 coupled with a suitable paddle 18 design produces an efficient mixing action.

The paddle 18 can be manufactured to extend to the entire height of the mixing container 10 thereby providing good mixing regardless of fill volume. The paddle 18 is typically a simple sheet of thermoformed flat plastic that can be made very inexpensively. Also, the paddle 18 may be made of a material such as acrylic, polypropylene, polyethylene, Acrylonitrile butadiene styrene (ABS) or any non-bioinert material. The flat paddle 18 design allows the mixing bag 21 to be packaged flat, reducing storage space and facilitating eventual disposal.

Figure 10:
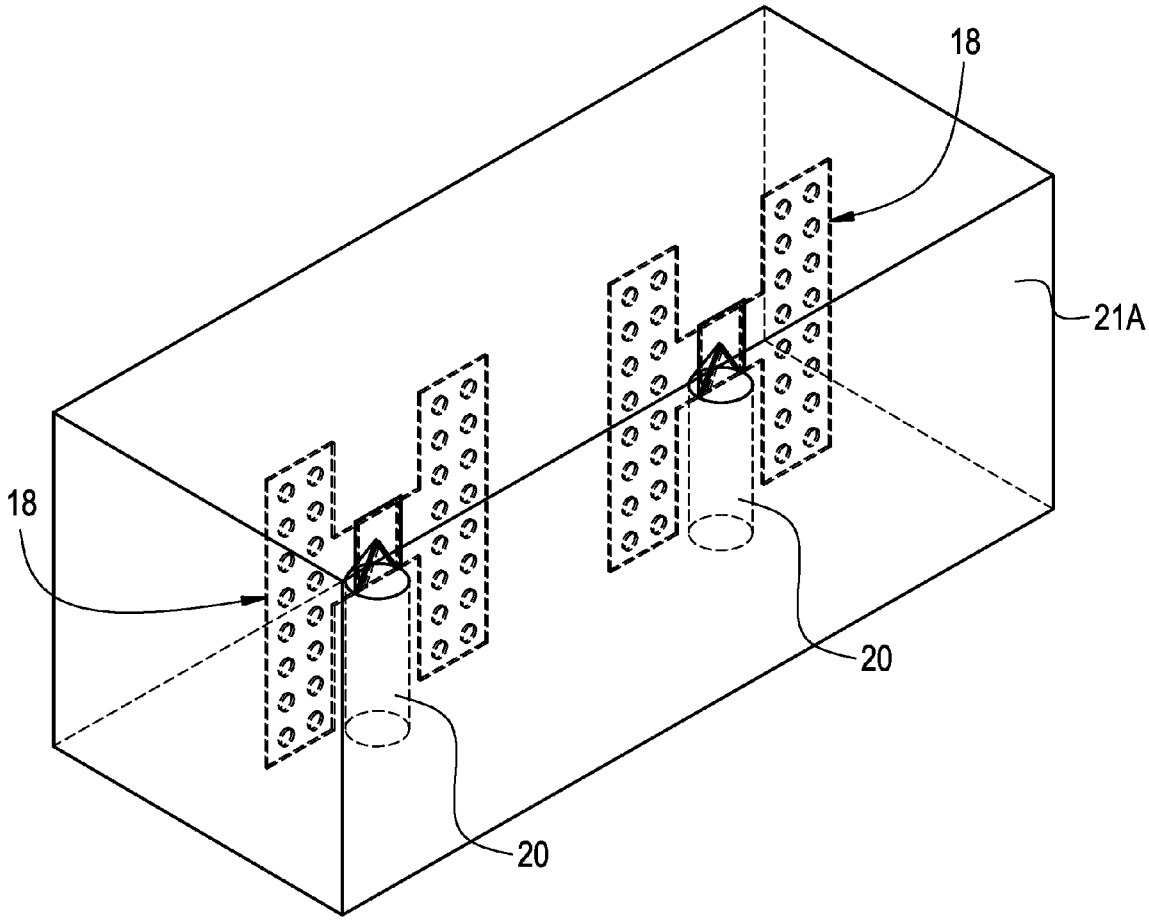
FIG. 10 is a perspective view of an embodiment of a large rectangular mixing apparatus with multiple mixing sleeves in accordance with the invention.

There are no potentially environmentally harmful magnetic stirrers or metal bearings used in the construction of the single use mixing container 16 making disposal of it easy. Scaling up of the mixing device 10 is simple, either by increasing the bag diameter to increase operating volume, or by increasing the height. Maintaining constant tip speed on scale up provides comparable performance at different volumes. The mixing device 10 is very compact with the footprint of a typical mixing tank. For large volumes, multiple sleeves 20, paddles 18 and driver assembly 40 can also be installed in the mixing container 10 (FIG. 10).

Since only the flexible sleeve 20, and not the mixing container 16, moves during operation, the mixing container 16 can be manufactured from a wide variety of materials, including multilayer and gas barrier films. This greatly increases the number of potentially usable films. The flexible sleeve 20, as stated above, can be made from a number of available materials based on compatibility and desired operating life.

Figure 3:
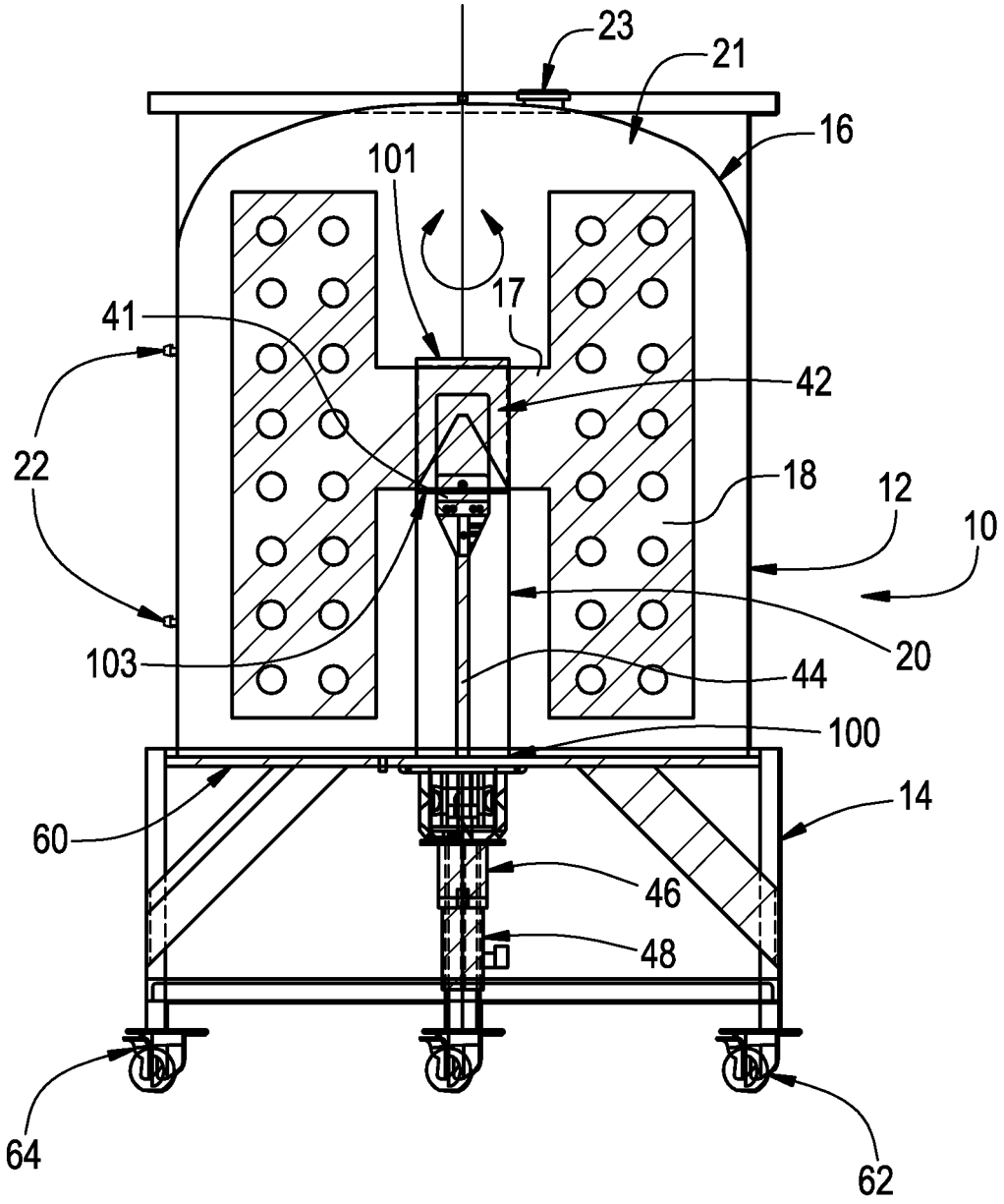
FIG. 3 is a cross sectional view of the mixing apparatus shown in FIG. 1 in accordance with the invention.

The cross-sectional view of the complete mixing device is shown in FIG. 3. The sleeve 20 is open to the outside of mixing bag 21 at lower edge 100. And the top seal 101 of sleeve 20 ensures that mixing bag 21 does not communicate with interior of the sleeve 20. Paddle 18 is disposed inside mixing bag 21 by a collar formed by seals 101 and 103, but does not communicate with the interior of the sleeve 20 due to seal 103. The paddle 18 includes a stirrer 15 connected to a hub 17. The hub 17 fits into clamp 42 through the sleeve 20 and is driven by the rotation of shaft 44, as shown in detail in FIG. 6B. In this manner, the interior of isolation sleeve 20 is completely isolated from the interior of mixing bag 21. This construction ensures that mixing bag 21 remains hermetically sealed during the mixing operation. Although the clamp 42 is shown as yoke shaped to receive a single hub 17, the hub 17 may be yoke shaped to receive a single clamp 42 or coupler 42.

Referring to FIG. 3, the mixing action is accomplished by filling mixing container 16 with the components or materials to be blended where the mixing container 16 also retains the materials or components. The components to be blended may be any type of media, such as buffer prep, salt, solid material, liquid, sugar, buffer solution, natural media and any other type of media known to those of ordinary skill in the art. These can be introduced through the open top or through ports 23 in mixing container 16. Ports 23 and 22 are provided on the mixing container 16 for the introduction and removal of components and for the installation of typical sensors and probes.

Referring to FIG. 2, when driver assembly 40 is actuated, it causes shaft 44 to rotate causing coupled paddle 18 to rotate through the same angle in a range of 1 to 360 degrees in either direction. The sleeve 20 is firmly attached to mixing bag 21 at seamed end 100. The rotation causes the sleeve 20 to twist so that the upper seam 101 is rotated by the same amount with respect to lower seam 100. After the completion of the first rotation through the set angle, the shaft 44 next rotates in the opposite direction back through the starting position to a set angle in the opposite direction. This action first untwists the sleeve 20 and then twists it in the opposite direction. The twisting and untwisting action can be repeated indefinitely because any twisting of the sleeve 20 is rapidly unwound in the opposite direction. Paddle 18 twists back and forth through this angle thoroughly stirring the fluid contained in mixing container 16. Even though one sleeve 20 is utilized, a plurality of sleeves can be utilized in this invention.

The shaft 44 has a much narrower diameter than the sleeve 20, so that as the sleeve 20 twists, its diameter is allowed to shrink down to a size equivalent to the outer diameter of driver shaft 44. An elastomeric coupling 41 can be provided in clamp 42 to allow the sleeve 20 to expand and contract slightly during the twisting operation. This greatly reduces the axial stress on isolation sleeve 20 as it twists. This mechanism does not require a rotary seal as a complete rotation never occurs.

The material of construction of the sleeve 20 must be chosen so that it is resistant to flexing and twisting. For the preferred embodiment of the invention, the sleeve 20 is made of a special formulation of polyethylene (ARMORFLEX®, obtained from ILC Dover, Del.). In another embodiment of the invention, the sleeve 20 may be made from materials, including coated fabrics nylon, polyvinyl and TEFLON®. The speed, acceleration rate, and angle of rotation can all be varied to optimize process performance, such as any angle of rotation in a range between 1 to 360 degrees in either direction. In the preferred embodiment, the best angle for the rotation of the sleeve 20 is 180 degrees in either direction and speeds ranging from 10 to 60 cycles per minute (cpm). Preferably, the sleeve 20 rotates at a speed of 10-30 cpm. The acceleration rate should be 10-300 revolutions per second$^2$ (rps$^2$). Preferably, the acceleration rate is 50 rps$^2$.

Referring to FIG. 2, dolly 14 comprises a frame 60 having a plurality of wheels 62 mounted thereon. Dolly 14 enables the easy transport of support 12. Locking devices 64 may be provided to prevent support 12 from moving while in operation. The locking devices 64 may be a wheel lock or a foot depressed lock. In alternate embodiments of the invention, where it is not necessary or desired to move support 12, wheels 62 can be eliminated and frame 60 can be placed directly on the ground or on any desired structure.

Figure 4:
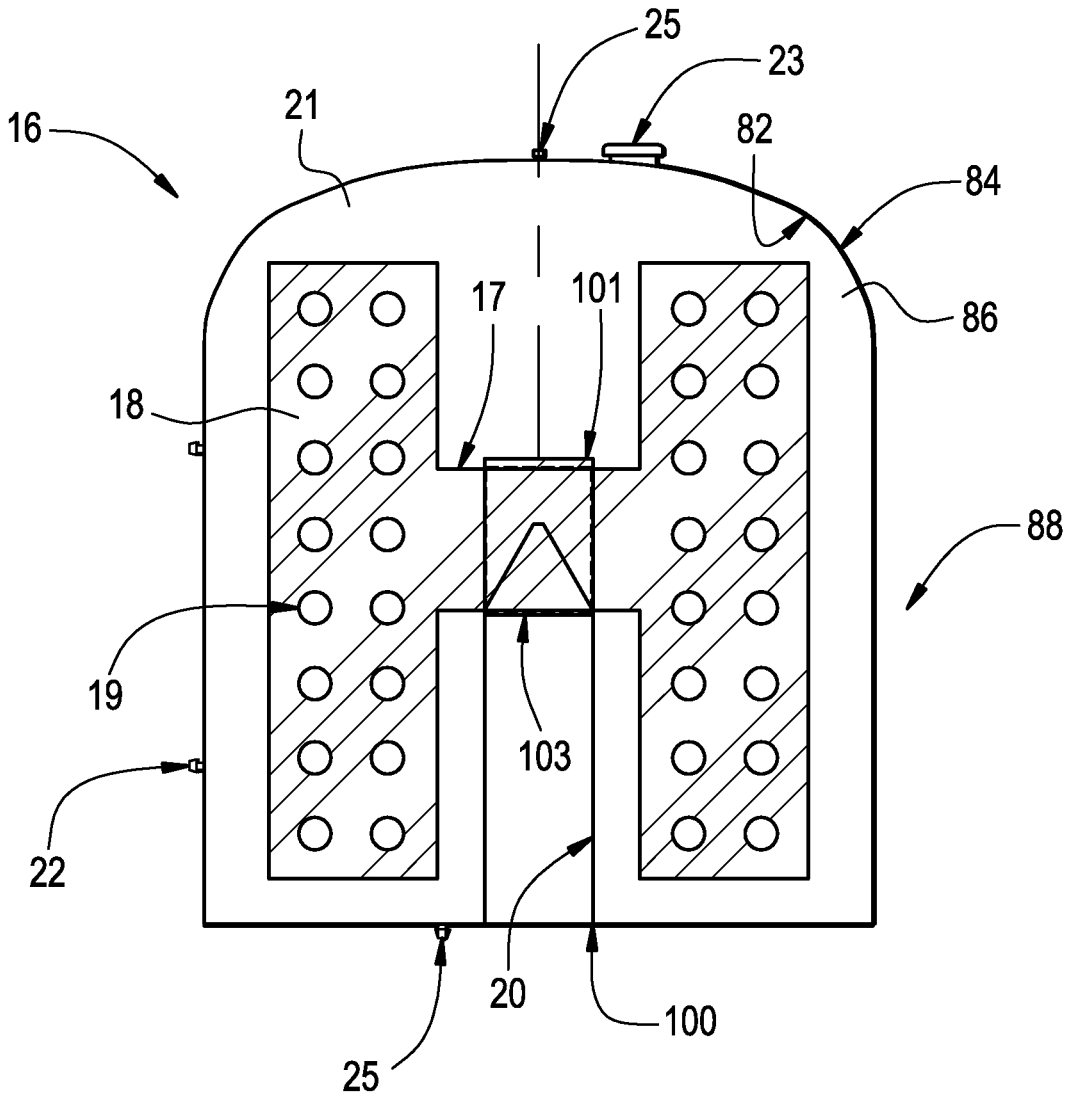
FIG. 4 is a cross sectional view of the mixing container shown in FIG. 1 in accordance with the invention.

Referring to FIG. 4, the mixing container 16 comprises a flexible and collapsible mixing bag 21 having an interior surface 82 and an exterior surface 84. Interior surface 82 bounds a compartment 86. The exterior environment 88 refers to the space exterior to compartment 86. Exterior environment 88 may also be referred to as environment outside of the mixing bag 21. Mixing bag 21 has a substantially cylindrical shape when unfolded and filled. In alternate embodiments, mixing bag 21 can be polygonal, elliptical, irregular or any other desired shape. Mixing bag 21 is comprised of a flexible, water impermeable material such as polyethylene of other polymeric sheets having a thickness in the range of 1 to 40 mils. In the preferred embodiment 20 mil ARMORFLEX® polyethylene (ILC Dover, Del.) was used. The material can be a single ply, bonded layers, multiple layers, or discrete layers of film. The layers can be made of the same or different materials.

Ports 22, 23 and 25 can be attached to mixing bag 21 during fabrication and are used to introduce materials, sample, and harvest products from mixing container 16. Ports may also be used to introduce typical sensors, such as required for measuring conductivity, pH level, temperature, ionic measurement, non-ionic measurement, non-conductivity, pressures, other types of measurements and oxygen into the mixing apparatus 10. These measurements are often required during mixing to determine homogeneity or to meter in ingredients. Such ports can be placed on the top, bottom, and sides of mixing bag 21. The ports are located to align with cutouts 34 and 36 on the support 12 shown in FIG. 2 so that such process transfers can be made with mixing bag 21 disposed in support 12. A window 38 may also be provided in the side wall 24 of the support 12 for visually monitoring the process as well as alignment of the paddle 18 and the clamp 42.

Figure 6A:
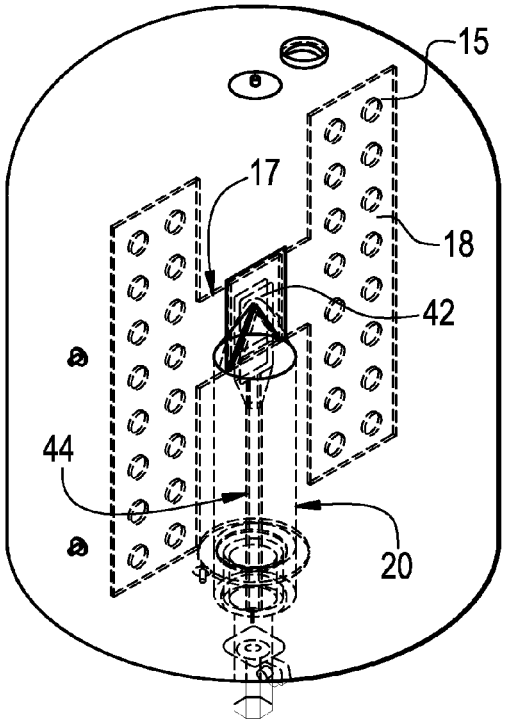
FIG. 6A is a perspective view of the mixing container in FIG. 5 in accordance with the invention.
Figure 6B:
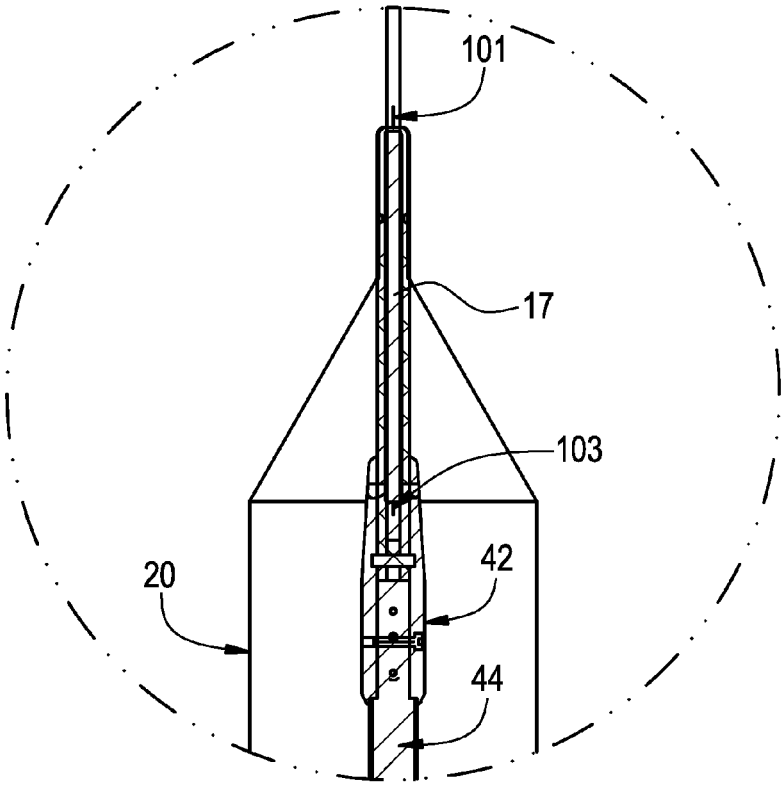
FIG. 6B is a cross sectional view of the of the sleeve's connection to the mixing container shown in FIG. 1 in accordance with the invention.

Referring to FIG. 4, the sleeve 20 includes a flexible sheet formed into a tube is placed inside mixing container 16. The sleeve 20 is seamed to the mixing bag 21 at the lower edge 100 by any one of the usual methods, such as radio frequency (RF) energy, ultrasonic process, laser for a period of anywhere between 1 to 10 minutes. Preferably, the seaming process is any where from 2 to 5 minutes. The seam must be made such that the interior of the sleeve 20 communicates with the outside of mixing bag 21. The sleeve 20 is seamed at 103 so that the interior 86 of mixing bag 21 cannot communicate with the exterior 88. Seam 103 is folded over by a typical folding method, and the hub 17 of the paddle 18 made of rigid plastic sheet (1 to 20 mm in thickness) is inserted into the sleeve 20 and mechanically retained by seam 101. The seams 101 and 103 form a collar to retain the paddle 18 on the sleeve 20. Refer to FIG. 6A and FIG. 6B for details of construction.

Figure 5:
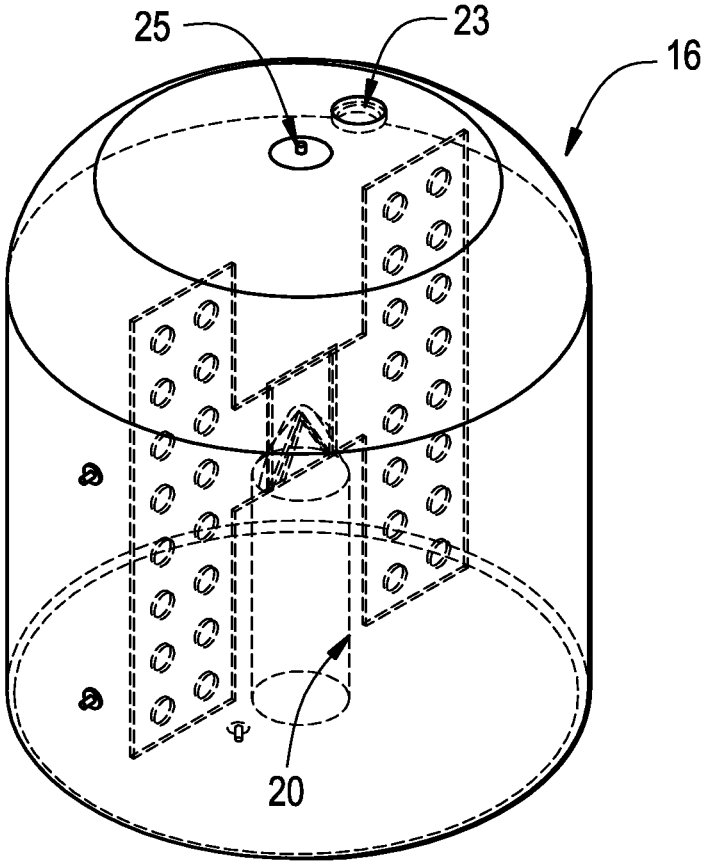
FIG. 5 is a perspective view of the seamed flexible panels of the mixing container shown in FIG. 1 in accordance with the invention.

In one embodiment shown in FIG. 5, mixing container 16 is a three-dimensional structure made by seaming thermoplastic sheets together. In this embodiment, mixing container 16 was constructed by laying two sheets together and seaming them to form a tube. The sleeve 20 is seamed into one edge which is folded and seamed across the corners to form a three dimensional bag when filled or inflated. The other end can also be folded and seamed across the corners to form a three dimensional top or it can just be left open. The seaming can be achieved by a variety of techniques depending on the nature of the polymeric materials. Such techniques include heat, RF energy, ultrasonic, laser, adhesives or other conventional process. It is appreciated that the shape and size of mixing container 16 can be altered by using different combinations of panels seamed together. Such bags can be manufactured for internal volumes ranging from 10 liters to 10,000 liters.

Figure 7A:
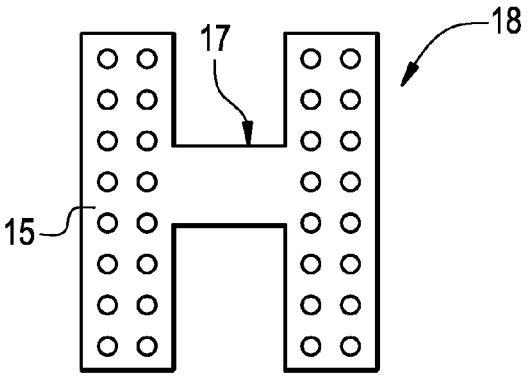
FIGS. 7A-7F shows various embodiments of mixing paddles in accordance with the invention.
Figure 7B:
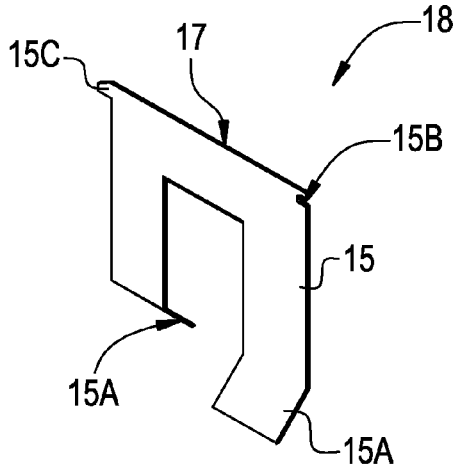

In the preferred embodiment, paddle 18 is a flat rigid plastic sheet cut in the shape of a letter H (FIG. 4). Holes 19 are included in paddle 18 to reduce drag and to force fluid through its orifices during the back and forth mixing motion. This promotes vortices and improves mixing efficiency. Numerous other paddle configurations can be envisioned. Some forms are shown in FIGS. 7A-7F. The paddles 18 can be flat as shown in FIGS. 7A, 7C, 7D and 7E or three-dimensional flow shaping appurtenances such as fins, flaps, and vanes as shown in FIGS. 7B and 7F in addition to the holes 19 of FIG. 4. FIG. 7A shows a paddle with perforations. These holes cause liquid jets to be formed when the paddle turns. The jets produce vortices that increase liquid shear. This in turn increases the mixing efficiency, and the ability to dissolve gases. The diameter and number of holes can be varied to meet process requirements. For example, smaller diameter holes are more effective when mixing viscous fluids.

FIG. 7B shows a paddle with bent legs. The bent legs 15A or these slanted surfaces deflect the liquid flow in the mixing container 16 so that a significant component of the flow is directed towards the bottom of the mixing container 16. This configuration is useful if it is desired to suspend or dissolve heavy solids as these tend to accumulate on the bottom. The paddles 15 in FIG. 7B have a bent lower end 15A, and a notch 15B and an extension 15C at their upper end.

Figure 7C:
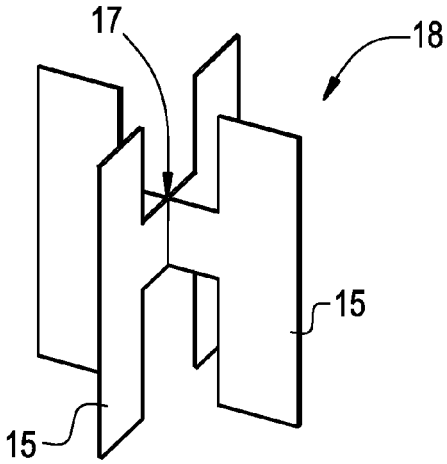
Figure 7D:
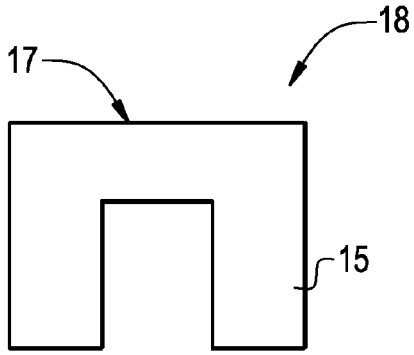

FIG. 7C shows a paddle with four sections. This design is useful for mixing fluids with minimal shear. This property may be required for biological fluids that are easily damaged by fluid shear. FIG. 7D shows a paddle with only a bottom mixing section. This design is useful when mixing fluids that are prone to foaming. In this design the paddle is located far below the liquid surface to minimize surface disturbances and consequent foam generation.

Figure 7E:
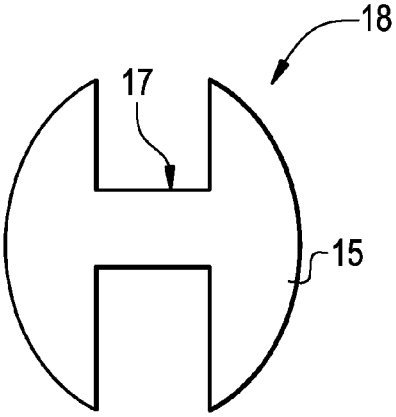
Figure 7F:
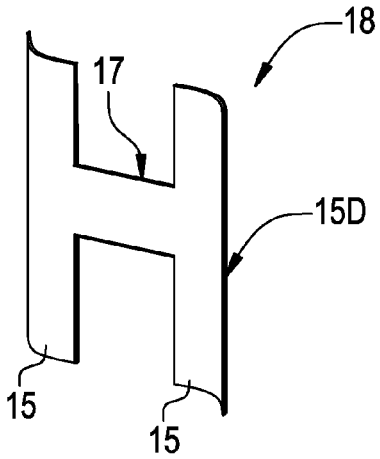

FIG. 7E shows a paddle with curved edges. This design is useful for mixing viscous fluids. It has a smaller cross-sectional area which requires less mixer power input. FIG. 7F shows a paddle with a curved profile. This design directs flow to the wall of the mixing container 16 and is useful in suspending or dissolving solids that tend to stick to the wall. A part of the liquid flow is directed towards the wall thereby washing away any material stuck or deposited on the mixing container wall. The paddles 18 in FIG. 7F have a bent side edge 15D. It may also have a plurality of stiffening ribs or thermoformed bends.

The paddle 18 may extend vertically from 5% to 95% of the vertical height of the mixing container 16. Also, the outer diameter of the path of the paddle 18 may be from 25% to 95% of the inner diameter of the mixing container 16.

Figure 8:
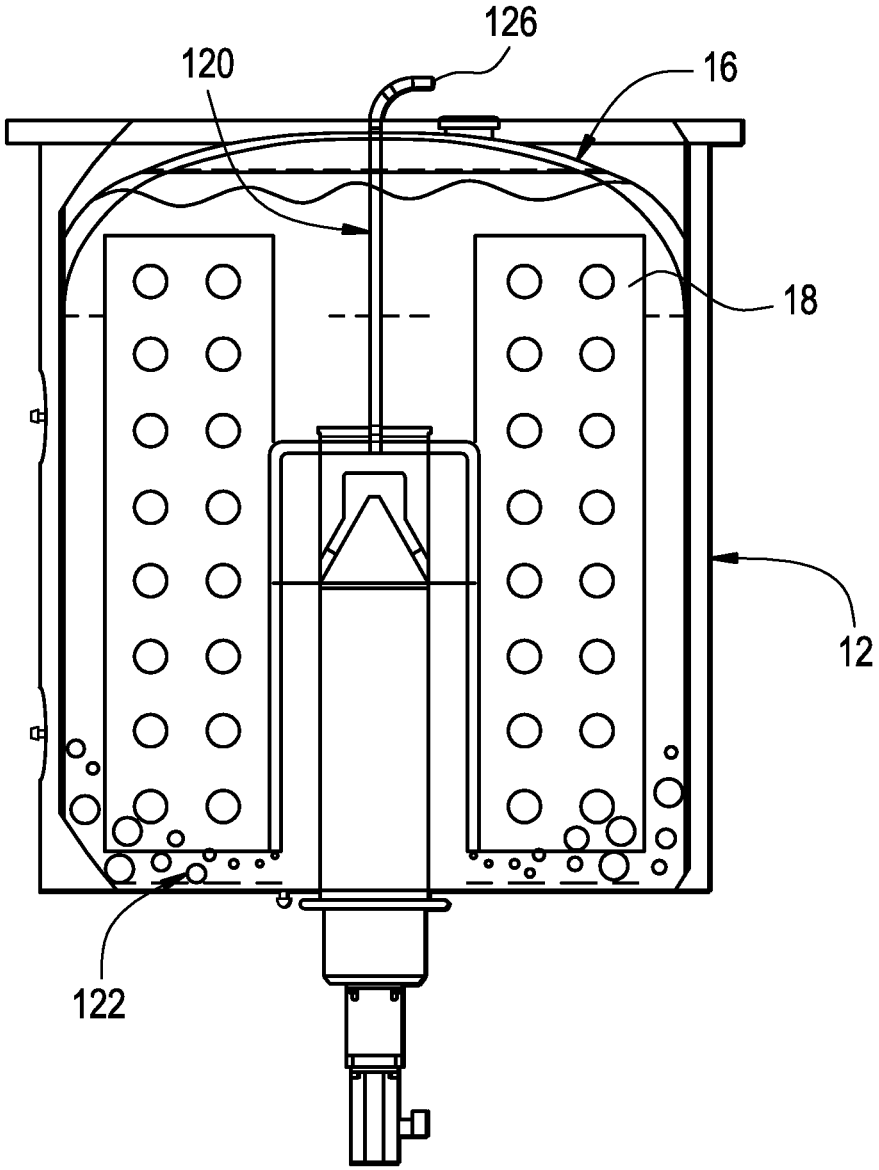
FIG. 8 shows an embodiment of an aeration device in accordance with the invention.

For applications requiring gas dispersion during mixing, such as fermentation or cell culture, an aeration device can be easily incorporated into mixing apparatus 10. In one embodiment shown in FIG. 8, a tube 120 is coupled to the sleeve 20 or paddle 18, where the tube 120 directs air 126 or provides aeration at the rate of 0 to 2 volumes per minute to the mixing bag 21 and to the materials. The tube 120 may direct air 126 continuously until the oxygen level reaches a certain point, such as 50% oxygen level in the mixing bag 21. In another embodiment of the invention, ph sensors and oxygen sensors may be utilized to determine the amount of gases, such as oxygen needed to direct air 126. Other gases may be utilized in place of oxygen, such as carbon dioxide and nitrogen. Bubbles 122 are introduced into the trailing edge of the moving paddle 18 and are rapidly dispersed into the fluid contained in mixing container 16. Alternatively a bubble diffuser may be attached to the bottom or sides of mixing bag 21 and air pumped into the bag through the diffuser.

Figure 9:
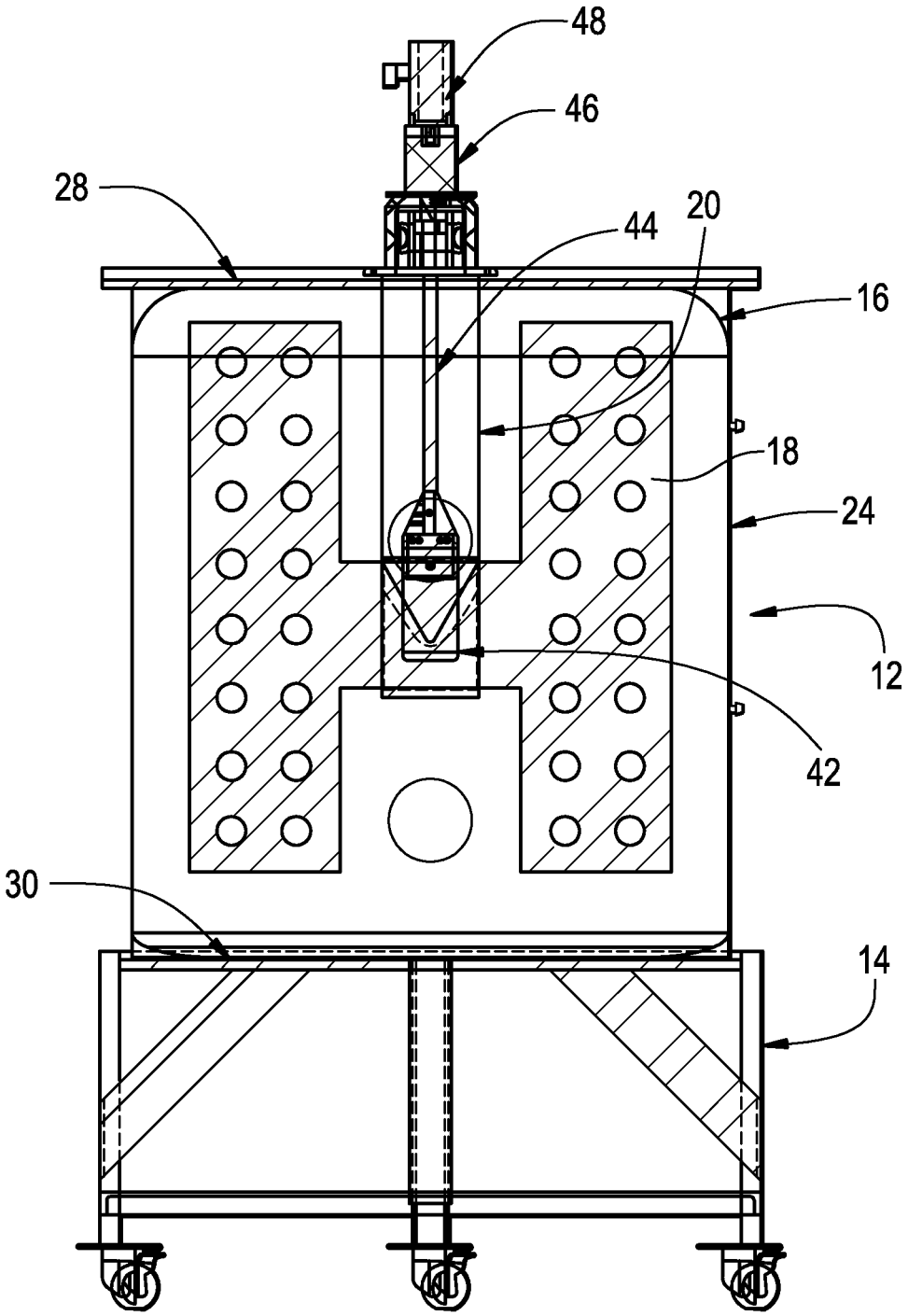
FIG. 9 is a perspective view of an embodiment with a top entering mixing shaft in accordance with the invention.

Another embodiment is shown in FIG. 9. Here the mixer assembly is introduced from the top instead of the bottom of support 12. The coupler 42 would be modified to mate and support the paddle 18 in the mixing container 16. The driver assembly 40 is mounted to a top wall 28 of the support 12. Driver assembly 40 may also be supported by an additional structure. By placing the driver assembly 40 on top of the bottom support 12 the movement of the driver assembly 40 will be less restrictive, which allows the user to add additional power to move the shaft 44. This configuration may be advantageous if space below support 12 is too restrictive to fit driver assembly 40.

Another embodiment is shown in FIG. 10. In this embodiment, a mixing bag 21A has a shape of a rhombohedra and the support 12 has a rectangular cross section. The shallow aspect ratio of the mixing bag 21A makes it inefficient to mix with just one mixer. As shown in FIG. 10, a plurality of isolation sleeves 20 with corresponding paddles 18 can be manufactured inside mixing bag 21A. These will couple with the requisite number of driver assemblies 40. The paddles 18 can be made to operate in an interlaced mode so as to maximize the mixing. Alternate embodiments can be envisioned with a polygonal or irregular shape.

Figure 11:
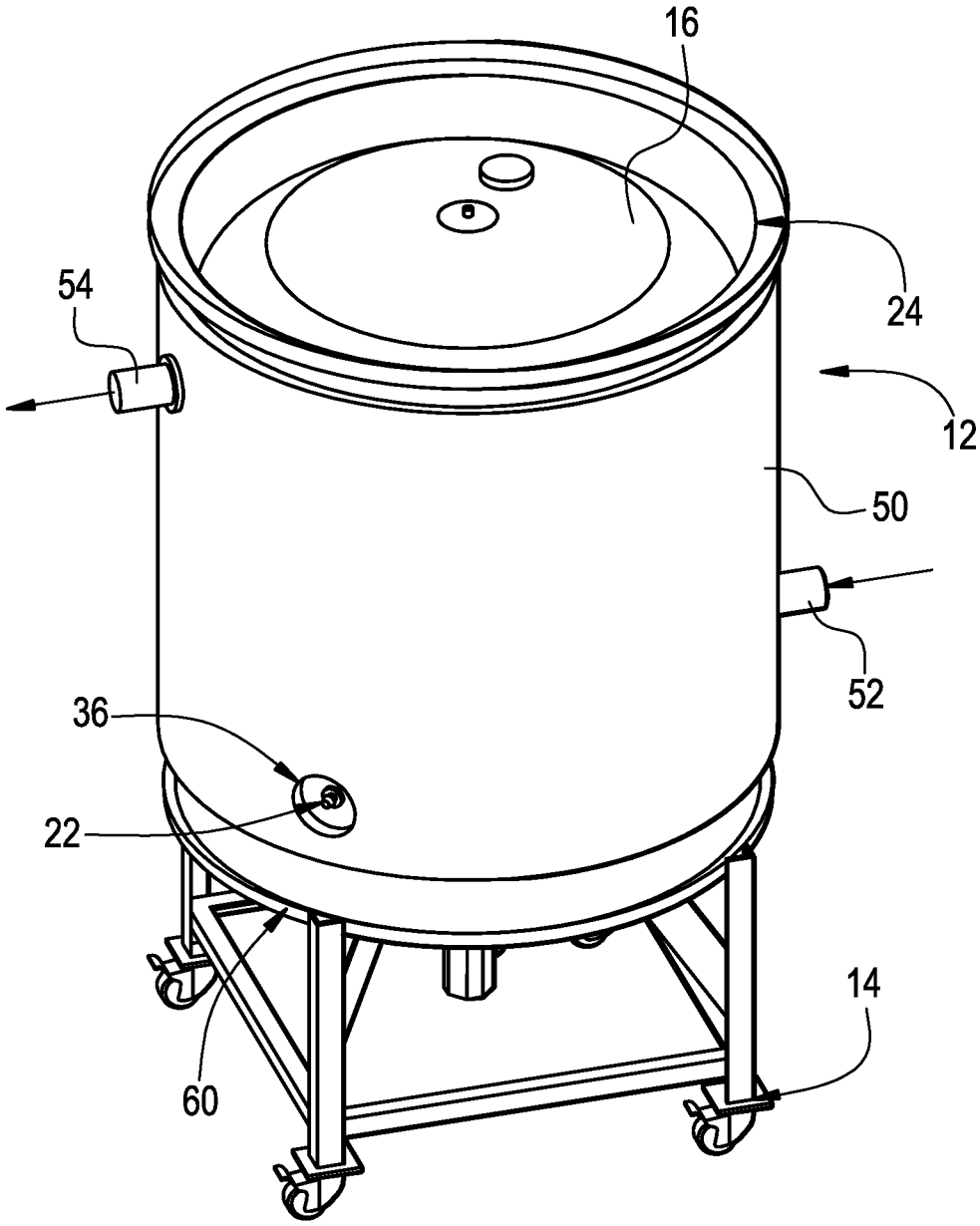
FIG. 11 is a perspective view of the mixing device with a heating/cooling jacket in accordance with the invention.

FIG. 11 shows another embodiment where support 12 is double walled or disposed within an inner wall 24 and an outer wall 50. The mixing container 16 is received in the inner wall 24. Hot or cold fluid can be circulated through the double wall jacket 24 and 50 via ports 52 and 54 to heat or cool the contents of a mixing bag 21 disposed inside support 12. Alternate embodiments of the invention, may utilize electric heating pads affixed to the outside wall 24 of a single walled support 12. Heating and cooling are readily achieved by providing a heat exchange jacket or an electrical heating pad on the exterior surface of the container support 12. The heat exchange jacket is useful because it heats or cools the bag, which is efficient in that it takes less than an hour to heat up the bag from 20 to 37 degrees Centigrade. The heating/cooling range is 2-60 deg C. Temperature measurement probes may be placed inside mixing container 16 via port 22, or the surface temperature of the bag can be used to estimate the temperature of the contents.

Figure 12A:
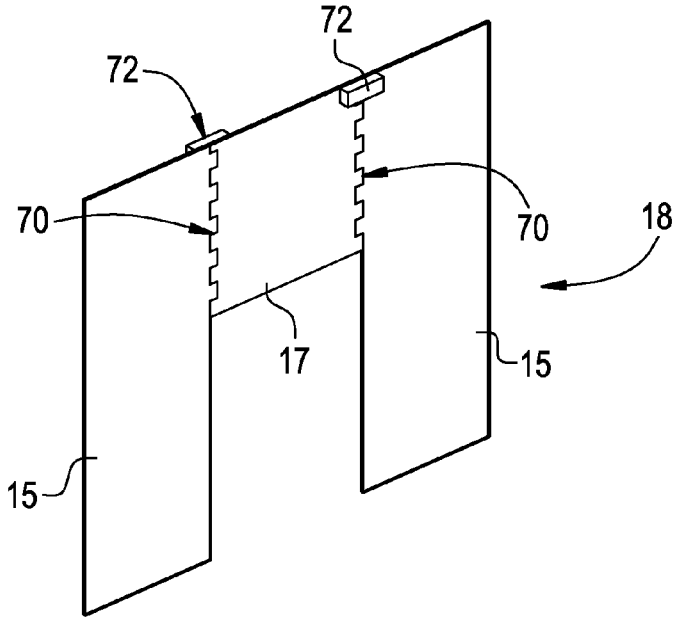
FIGS. 12A-12C shows an embodiment of the mixing paddle with a vertical hinge in accordance with the invention.
Figure 12B:
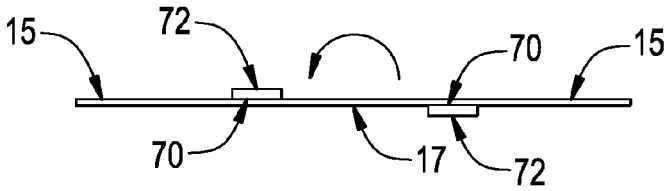
Figure 12C:
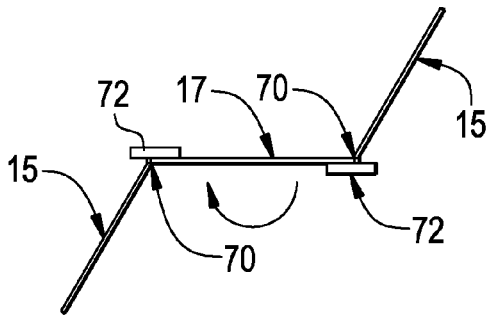
Figure 13A:
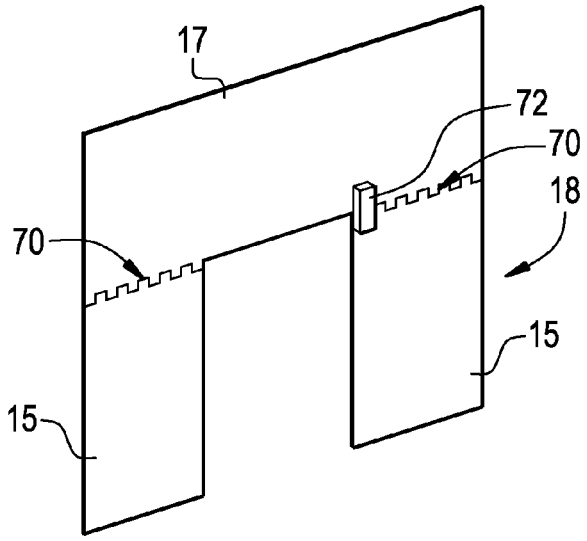
FIGS. 13A-13C shows an embodiment of the mixing paddle with a horizontal hinge in accordance with the invention.
Figure 13B:
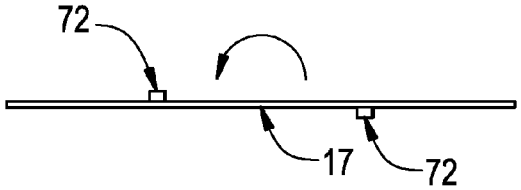
Figure 13C:
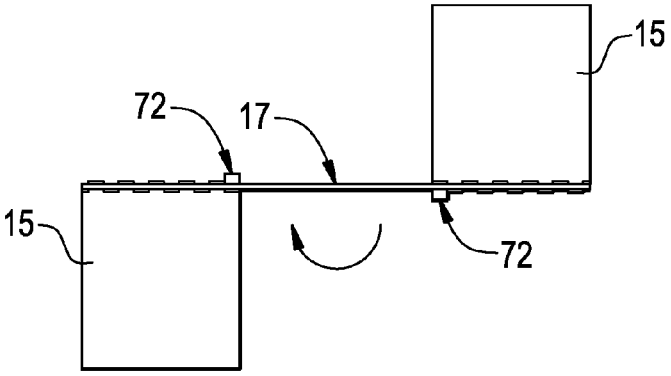

The paddle 18 may include hinged panels that extend during rotation in one direction and retracts in the other direction, as shown in FIGS. 12 and 13. The stirrer 15 is connected to the hub 17 by hinges 70. A stop 72 for each stirrer 15 is mounted to the hub 17 to limit the pivoting of the stirrer 15 in one direction of rotation and hold it in a fixed position in the other direction of rotation. As shown in FIGS. 12B and 13B, rotation of the paddle 18 in the counter-clockwise direction maintains the stirrer 15 fixed. The stirrer 15 rotate from the fixed position for clockwise rotation as shown in FIGS. 12C and 13C. Some stirring does take place during the clockwise rotation due to the hub 17. The amount of stiffing on the clockwise rotation can be adjusted by changing the position of the hinges 70.

Figure 14:
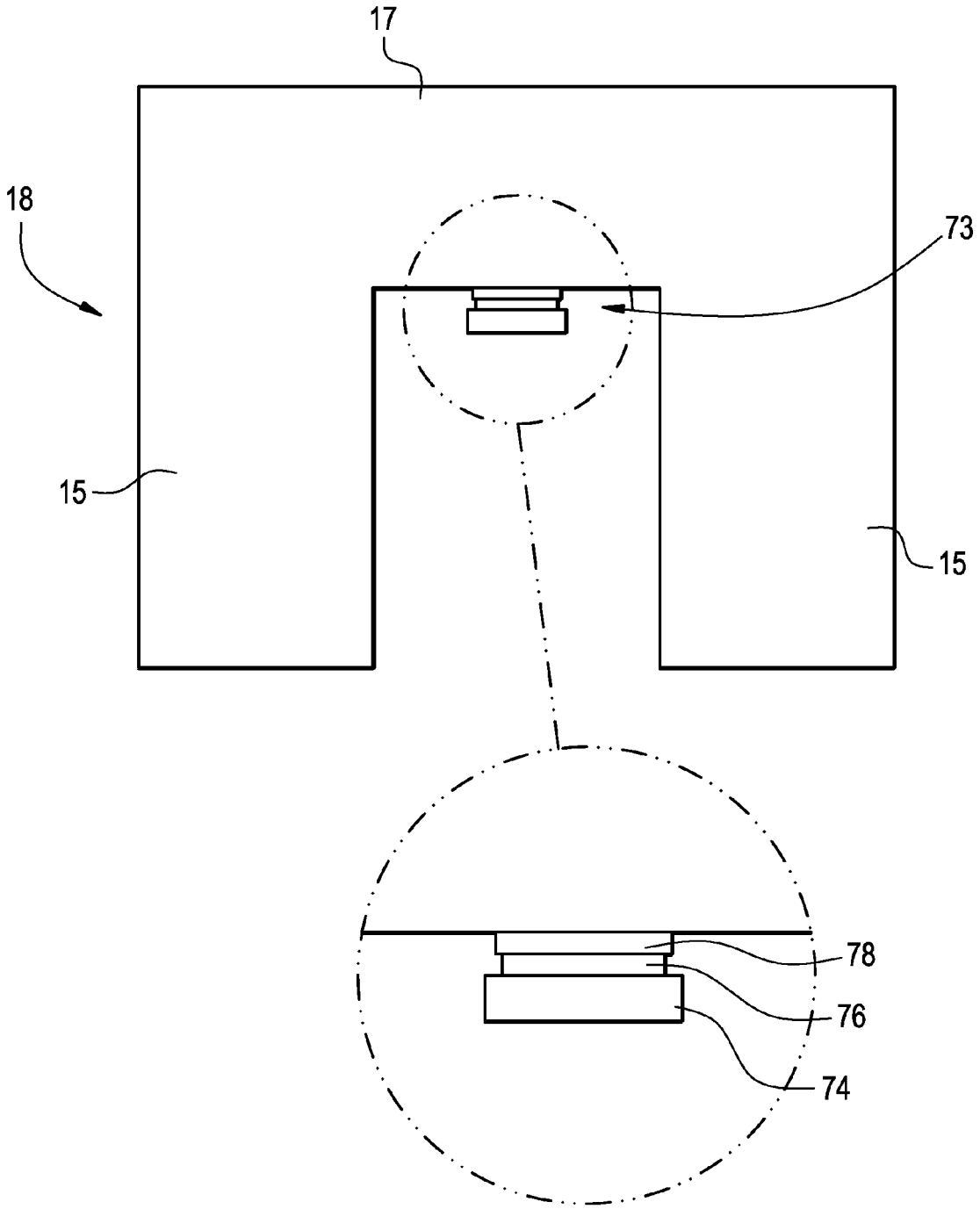
FIG. 14 shows an embodiment of an unidirectional mixing paddle in accordance with the invention.
Figure 15:
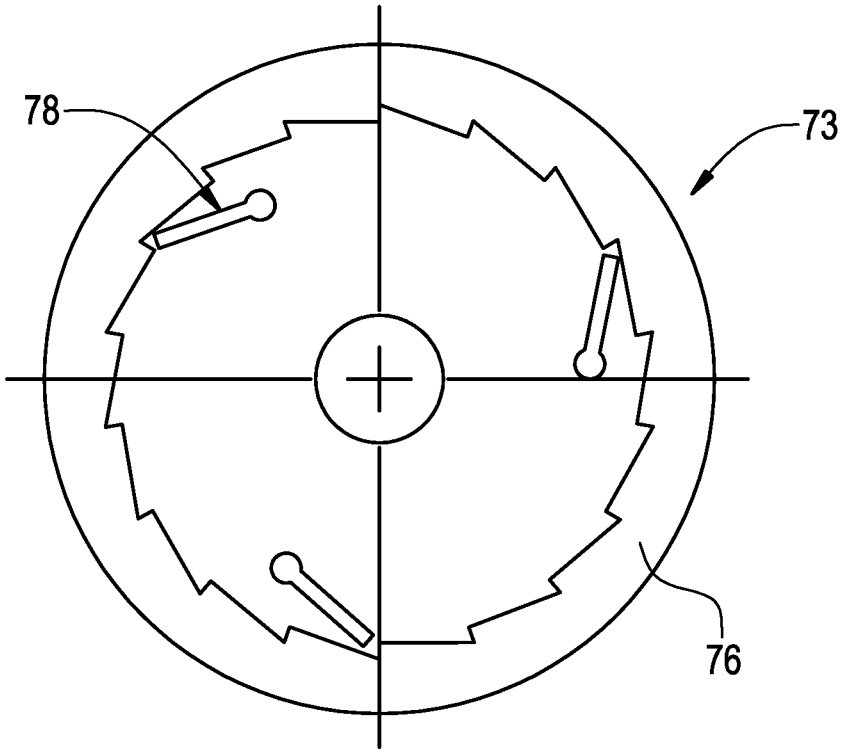
FIG. 15 shows an embodiment of a unidirectional drive mixing paddle in accordance with the invention.

If stirring only in one direction is required, a transmission can be provided to convert the oscillating movement of the drive shaft to a single direction movement of the paddle 18. As shown in FIGS. 14 and 15, a unidirectional transmission 73 is provided between the hub 17 and a portion 74 of the hub which will mate with the clamp 42 of the drive shaft 44. The transmission 73 includes a ratchet portion 76 and a pawl portion 78. In the illustrated example of FIG. 15, counter-clockwise rotation rotates the paddle 18 and clockwise rotation is free wheeling. Although the unidirectional transmission 73 is shown as a pawl and ratchet, another type of unidirectional transmission may be used.

This invention provides an apparatus that allows a user to simply and efficiently mix materials in a disposable mixing system. The user is able to insert media into a mixing bag assembly of the disposable mixing system, where he is able to mix the media by using a driver assembly. The driver assembly is coupled to a paddle that oscillates back in forth at a particular angle to mix the contents of the media in an efficient manner. Thus, this invention provides the user with a disposable mixing system that yields a good mixing performance and is efficient.

Although the present invention has been described above in terms of specific embodiments, many modification and variations of this invention can be made as will be obvious to those skilled in the art, without departing from its spirit and scope as set forth in the following claims.

What is claimed is:

1. An apparatus for mixing materials, comprising:

a support;

a mixing container disposed in the support, wherein the mixing container is configured to retain materials and wherein the mixing container includes a mixing bag with at least one sleeve;

a driver assembly configured to protrude through the support and into the mixing container;

the driver assembly connected to a drive shaft; and the mixer container includes a paddle, the driver assembly is configured to be attached to the paddle, wherein the driver assembly oscillates the drive shaft, and wherein the drive shaft is connected to a unidirectional transmission, and wherein the paddle is driven in a single direction in order to mix the materials in the mixing container.

2. The apparatus of claim 1, wherein the driver assembly further comprises:

an electric servo motor coupled to a gearbox, wherein the gearbox is coupled to a drive shaft.

3. The apparatus of claim 1, wherein the unidirectional transmission is provided between a hub and a portion of the hub which will mate with a clamp of the drive shaft.

4. The apparatus of claim 1, wherein the rotation of the paddle is freewheeling.

5. The apparatus of claim 4, wherein the transmission includes a ratchet portion and a pawl portion.

6. The apparatus of claim 2, wherein the drive shaft is moved by the devices selected from the group consisting of servo motors, gearboxes, gears, cams, pneumatic pistons, or hydraulic pistons.

7. The apparatus of claim 1, wherein the mixing bag and the at least one sleeve are seamed together.

8. The apparatus of claim 1, wherein the sleeve is made from a material that is a single ply or has a plurality of layers of film.

9. The apparatus of claim 8, wherein the material of the sleeve is selected from the group consisting of a coated nylon, a siliconized coating, polyethylene and silicon.

10. The apparatus of claim 1, wherein the paddle is a made of a material selected from the group consisting of polypropylene, polyethylene, acrylic, Acyrlonitrile butadiene styrene or any non-bioinert material.

11. The apparatus of claim 1, wherein the mixing bag is made from a material that is flexible and water impermeable.

12. The apparatus of claim 1, wherein the mixing bag is made from a polyethylene material.

13. The apparatus of claim 1, wherein the mixing bag has a thickness in a range of 1 to 40 mils.

14. The apparatus of claim 1, wherein the paddles have a plurality of holes.

15. The apparatus of claim 1, wherein the paddle have slanted surfaces.

16. The apparatus of claim 1, wherein the paddle includes a stirrer attached to a hub.

17. The apparatus of claim 16, further comprises a stop mounted on the stirrer.

* * * * *